US006014529A

United States Patent [19]

Sato

[11] Patent Number: 6,014,529

[45] Date of Patent: Jan. 11, 2000

[54] CHARGING APPARATUS

[75] Inventor: Hiroshi Sato, Shizuoka-ken, Japan

[73] Assignee: Canon Kabushiki Kaisha, Tokyo, Japan

[21] Appl. No.: 09/187,400

[22] Filed: Nov. 6, 1998

[30] Foreign Application Priority Data

Nov. 7, 1997 [JP] Japan ..... 9-305740

[51] Int. Cl.[7] ..... G03G 15/02

[52] U.S. Cl. ..... 399/50; 399/176; 361/221; 361/225

[58] Field of Search ..... 399/50, 66, 176, 399/313; 361/225, 221; 492/56

[56] References Cited

U.S. PATENT DOCUMENTS 5,420,671 5/1995 Kisu et al. .
5,646,717 7/1997 Hiroshima et al. ..... 399/154
5,701,551 12/1997 Honda et al. ..... 399/50

*Primary Examiner*—Richard Moses
*Attorney, Agent, or Firm*—Fitzpatrick, Cella, Harper & Scinto

[57] ABSTRACT

A charging apparatus includes a rotatable charging roller contactable to a member to be charged to electrically charge the member to be charged. The eharging roller includes a foam member and is supplied with a voltage including an oscillating component. A control means is provided for constant-current-control of the oscillating component. When the constant-current-control is carried out, a response time of the constant-current-control is longer than time required for a width to be charged to pass through a discharge area between the charging roller and the member to be charged.

11 Claims, 3 Drawing Sheets

CHARGING APPARATUS

FIELD OF THE INVENTION AND RELATED ART

The present invention relates to a charging apparatus, which is used in an image forming apparatus, such as a copying machine or a laser beam printer, which is based on an electrophotographic system or an electrostatic recording system.

In an image forming appaatus, for example, an electrophotographic apparatus, an electrostatic recording apparatus, and the like, an image bearing member, as an object to be charged, is eletrically charged on the peripheral surface layer formed of photosensitive material, dielectri mterial, or the like. In the past, as a means for charging the image bearing member, charging methods based on corona discharge have began commonly used, in the corona based charging method, which are of a noncontact type, a high voltage is applied to a piece of fine wire, i.e., a corona discharge wire, causing corona discharge, and the peripheral surface of the image bearing member is electrically charged by the corona discharge.

In recent years, however, a contact type charging system has been threatening to become the mainstream charging method for its advantages such as being a low voltage process, low in ozone generation, and low in cost. In a contact type charging system, the peripheral surface of an image bearing member, as an object to be charged, is electrically charged by applying voltage to a charging member placed in contact with the peripheral surface of an image bearing member. The charging member is in the form of a roller, a blade, or the like. Among charging members of various forms, a charging member, in particular, in the form of a roller, can reliably charge an object and has a long service life.

The voltage to be applied to the charging member may be only a DC voltage. However, application of an alternating voltage helps to charge the peripheral surface of an object to be charged more uniformly than application of only a DC voltage.

It has been known that applying an alternating voltage, for example, compound voltage composed of an AC voltage, the peak-to-peak voltage of which is no less than twice the voltage (threshold voltage), at and above which electric charge occurs between an object to be charged, and the charging member, when a DC voltage is applied to the charging member, and a DC voltage (offset bias), is effective to average the potential given to the object, that is, effective to uniformly charge the object. The waveform of the oscillating voltage does not need to be limited to a sine waveform; the oscillating voltage may be in the rectangular waveform, the triangular waveform, or the pulse waveform. Further, the oscillating voltage includes an oscillating voltage in the rectangular waveform formed by periodically turning on and off a DC voltage, an oscillating voltage formed by periodically changing DC voltage in terms of potential level so that its average potential level becomes the same as the average potential level of the aforementioned compound voltage composed of AC voltage and a DC voltage, and the like oscllliating voltages.

A contact type charging system which applies oscillating voltage to a charging member to charge an object, as described above, will be referred to as "AC charging system". The AC component, that is, the oscillating component, of oscillating voltage will be referred to as "AC component" or "AC voltage", and the DC component, that is, the non-oscillating component, of oscillating voltage will be referred to a "DC component" of a "DC voltage".

As ambient conditions change, the resistance value of a charging member changes. The amount of this change is dependent upon the material of the charging member, and sometimes approaches the next order of magnitude. In other words, if the charging apparatus is controlled so that the potential level of the AC voltage applied to the charge roller remains constant, an object to be charged may be incorrectly charged. For example, under a low temperature-low humidity ambient conditions the material of the charging member dries, which increases the resistance of the charging member. Therefore, the object to be charged is insufficiently charged. On the other hand, under high temperature-high humidity ambience, the material of the charging member absorbs tumidity, which decreases the resistance of the charging member. Therefore, an excessively high AC voltage is applied to the charge roller. In such a case, an excessive amount of electric discharge occurs between the charging member and the image bearing member, through microscopic gaps adjacent to the contact nip between the two members, which causes damage to the peripheral surface of the image forming member. As the damaged areas of the peripheral surface of the image bearing member are rubbed or scraped by a cleaning member or the like, they are frictionally worn by an excessive amount, greatly reducing the service life of the image bearing member.

Known as a means for avoiding the above described problem is a method which executes control to keep constant the AC component applied to the charging member. This method is effective because of the following reason. That is, as impedance increases due to ambient factors such as low temperature-low humidity, or a circumstantial factor such as tolerance in charging member manufacture, the potential level of the applied AC voltage (peak-to-peak voltage) rises (Ohm's law) because control is being executed to keep constant the amount of the AC current supplied to the charging member. Therefore, an object to be charged is prevented from being insufficiently charged. On the other hand, as temperature ad humidity increase, the potential level of the applied AC voltage necessary to uniformly charge the charging member falls, and at the same time, the impedance of the charging member also decreases. Therefore, the potential level of the applied AC voltage (peak-to-peak voltage) falls because control is being executed to keep constant the amount of the AC current supplied to the charging member. Thus, the aforementioned problem that excessively high voltage is applied to the charging member can be avoided.

When an AC voltage is applied to the charging member, an electrical field is generated between the charging member and the grounded base of the image bearing member; electrical force is generated between the charging member and the image bearing member. The magnitude of this force changes in response to the applied voltage. sometimes causing the image bearing member to vibrate and generate noise called charge noise.

Known as a means for avoiding the above problem is to use a charging member which comprises a surface layer composed of foamed material. With the amployment of foamed material as the material for the surface layer of a charging member, the vibration caused by the electrical force generated between the charging member and the image bearing member is absorbed by the charging member. In other words, the charging noise is reduced.

On the other hand, a charging member charges the peripheral surface of the image bearing member through electric discharge which occurs through microscopic gaps between the peripheral surfaces of the charging member and an image bearing member. Therefore, in order to uniformly charge the image bearing member, the size of the gap must remain constant, which requires the peripheral surface of the charging member to be as smooth as possible. Thus, a charging member which comprises a surface layer composed of foamed material is desired to be covered with a skin layer, or to be given a laminar structure constituted of the smooth surface and one or more underlayers.

However, if a charge roller which comprises a surface layer formed of foamed material is left for an extended length of time in the state of being pressed upon the peripheral surface of the photosensitive drum (in particular, prior to when a process cartridge in which the charge roller is disposed is used for the first time), the foamed material portion of the charge roller, which is low in hardness, sometimes permanently deforms. In other words, the charge roller permanently deforms across the portion in contact with the peripheral surface of the image bearing member. If a charge roller which has deformed as described above is used to charge a photosensitive member, the photosensitive member is sometimes insufficiently charged across the portion which passes the charging station when the deformed portion of the charge roller passes the charging station. Referring to FIG. 5, the gap formed between the deformed portion of the charge roller, and the photosensitive roller, that is, the gap on the right-hand side of the contact nip between the two members in the drawing, and the gap formed between the normal portion of the charge roller, and the photosensitive member, that is, the gap on the left-hand side of the contact nip, are different in shape, and therefore, the size of the space within which an electric discharge can occur, that is, the electric discharge space, on the side with the normal portion of the charge roller is different from that on the side with the deformed portion of the charge roller. Further, the amount of the current caused to flow by the AC voltage applied to the charge roller changes in proportion to the size of the electric discharge space, Thus, under the constant current control, the value of the AC voltage (peak-to-peak voltage), which is being applied to the charge roller, changes in response to the change in the size of the electric discharge space. If this change in the value of the AC voltage puts the potential level of the AC voltage, which is being applied to the charge roller, outside the voltage range within which the photosensitive member is desirably charged, the photosensitive member is undesirably charged, which results in an undesirable image, that is, an image marred with parallel black and white stripes located adjacent to each other.

SUMMARY OF THE INVENTION

The primary object of the present invention is to provide a charging apparatus which desirably charges an object regardless of the state of contact between the object to be charged and the charging member.

Another object of the present invention is to provide a charging member which desirably charges an object even after the peripheral surface of the charge roller deforms due to the contact between the charge roller and the object to be charged.

Another object of the present invention is to provide a charging apparatus which uniformly charges an object regardless of ambient conditions such as temperature or humidity.

Another object of the present invention is to provide a charging apparatus in which the peak-to-peak. voltage of the alternating voltage applied to the charge roller does not fluctuate even if the state of contact between the object to be charged and the charge roller changes.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Embodiment 1

Hereinafter, the embodiments of the present invention will be described in detail with reference to the appended drawings.

Figure 2:
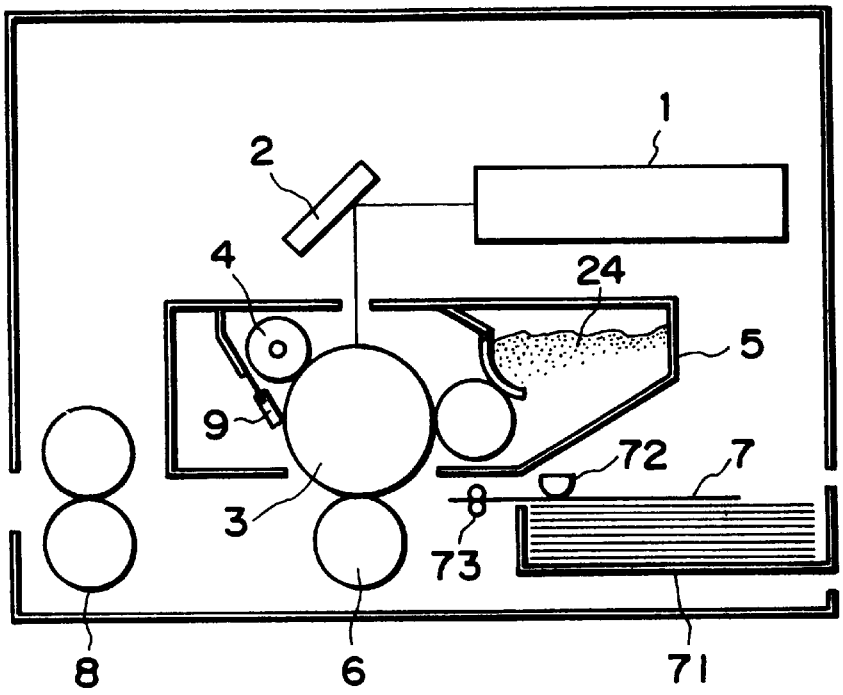
FIG. 2 is a schematic vertical section of the image forming apparatus in the first embodiment.

FIG. 2 is a schematic section of the image forming apparatus in the second embodiment of the present invention, and depicts the general structure thereof. In this image forming apparatus, a laser beam modulated with image signals is outputted from a scanner unit 1 which comprises a laser, a polygon mirror, and a lens system, is deflected by a deflection mirror 2, and arrives at the peripheral surface of the photosensitive drum 3 as an image bearing member, on the portion which has been uniformly charged by a primary charging device 4 which comprises a charge roller. As a result, an electrostatic latent image is formed on the peripheral surface of the photosensitive drum 3. This electrostatic latent image is developed into a visual image, that is, a toner image, by a toner 24 in a developer apparatus 5. Meanwhile, a piece of recording medium 7 which has been held in a cassette 71 is delivered to the registration roller 73 by a sheet feeder roller 72 in synchronism with the formation of the latent image on the peripheral surface of the photosensitive drum 3. Then, the recording medium 7 is conveyed to a transfer charging device 6, which consists of a transfer roller, in synchronism with the leading edge of the latent image on the photosensitive drum 3. At the transfer charging device 6, the toner image is transferred onto the recording medium 7 by the transfer charging device 6. The toner image, which has been transferred onto recording medium 7, is permanently fixed to the recording medium by a fixing apparatus 8. Therefore, the recording medium 7 is discharged from the image forming apparatus, ending a single cycle of image formation. The toner particles which have remained on the peripheral surface of the photosensitive drum 3 are removed by a cleaning apparatus 9 which consists of an elastic blade.

The features which characterize this embodiment of the present invention are as follows. That is, the charging apparatus in this embodiment comprises a charging member which partially consists of foamed material. It charges the peripheral surface of the image bearing member, on which an electrostatic latent image is formed. It applies to the charging member, a charge bias which includes oscillating component. In charging the peripheral surface of the image bearing member, the oscillating component (alternating current component) is subjected to the constant current control, and the response time of the constant current control is set be longer than the time it takes for the deformed portion of the charge roller passes through the electric discharge region. With this arrangement, the peak-to-peak voltage (potential level of AC voltage) does not fluctuate while the deformed portion of the charging member passes the electric discharge region. Therefore, even after the charging roller permanently deforms, the peripheral surface of the image bearing member is desirably charged.

Figure 1A:
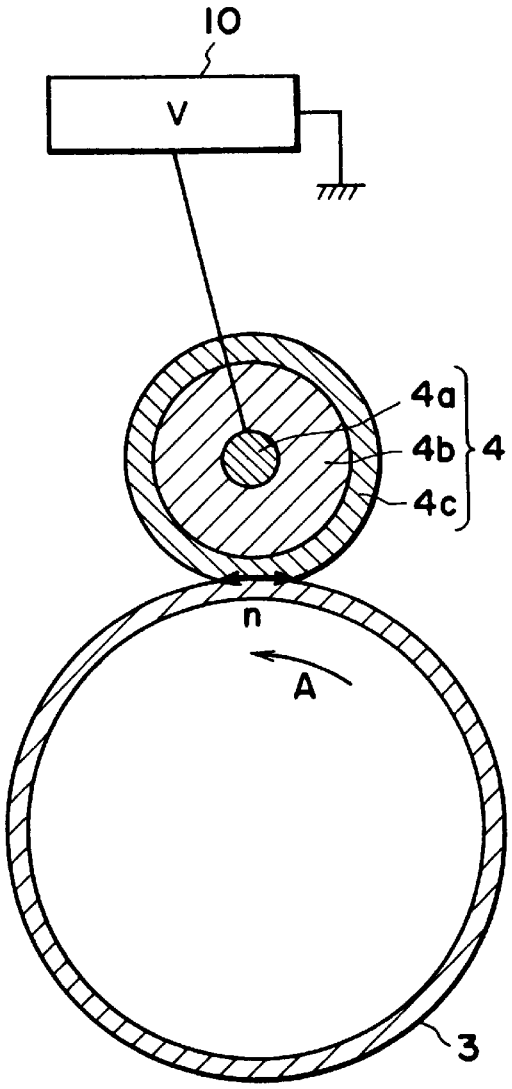
FIG. 1, consisting of FIGS. 1(*a*) and 1(*b*), are a schematic cross-sectional drawing which depicts the first embodiment of the present invention.
Figure 1B:
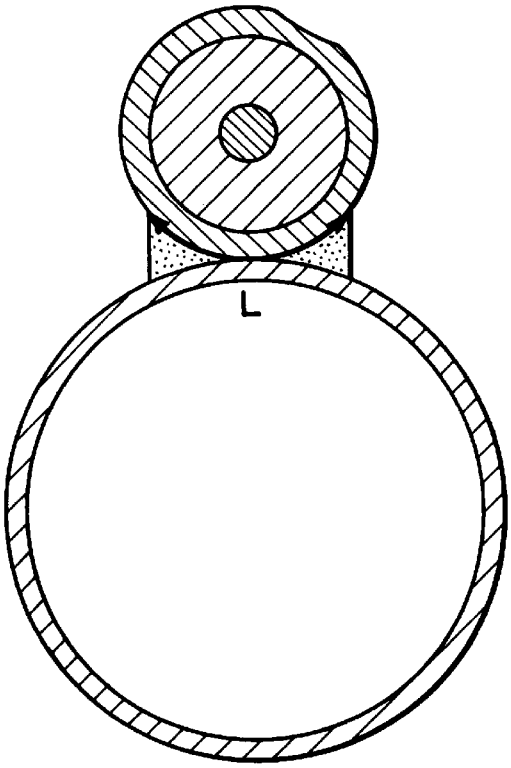

Hereinafter, this embodiment will be concretely described with reference to FIGS. 1(*a*) and 1(*b*).

As for the photosensitive drum 3, that is, an object to be charged, a known photosensitive drum of an organic type is employed. It is chargeable to negative polarity and has an external diameter of 30 mm. It is rotated in the direction indicated by an arrow mark A at a process speed Vp of 100 mm/sec.

The charging roller 4 consists of a metallic core 4*a* with a diameter of 6 mm, an electrically conductive base layer 4*b* formed of flexible foamed EPDM in which carbon has been dispersed, and a smooth and flat surface layer 4*c* formed of acrylic urethane in which carbon has been dispersed. It is 12 mm in diameter. The volumetric resistivity of the surface layer 4*c* is desired to be rendered greater than that of the base layer 4*b*. More specifically, it is desired to be in a range of $10^5$–$10^9$ ohm.cm. The charge roller 4 is kept in contact with the photosensitive drum 3 by a predetermined amount of pressure applied to the metallic core 4*a*, on the longitudinal ends, by unillustrated elastic members such as springers. The charge roller 4 simply follows the rotation of the photosensitive drum 3. To the charge roller 4, charge bias, that is, oscillating voltage, which is composed of a DC voltage Vdc of −600 V as the nonalternating component, and an alternating voltage as the oscillating component, is applied from a power source 10 through the metallic core 4*a*. In charging the photosensitive drum 3. the AC component of the charge bias is subjected to the constant current control. In a test in which the frequency of the charge bias was set at 1000 Hz, and the amount of the current was kept constant at 1000 $\mu$m, a peak-to-peak voltage Vp of 2 kV was applied to the charging member under the normal temperature-normal humidity ambience (23° C. and 64%).

The electric discharge regions are defined as such regions that are adjacent to the charging nip between the charge roller and the photosensitive drum 3, and also satisfy the following Paschen's law (1).

$$V\ (V) > 312 + 6.2d\ (\mu m) \quad (1)$$

More specifically, the size of the discharge gap is calculated from the potential level of the AC voltage applied to the charge roller, and the boundaries of the electric discharge regions were determined based on the thus calculated size of the electric discharge gap. It should be noted that the boundaries of the electric discharge regions can be determined using the following method. That is, the photosensitive drum 3 is charged while keeping the photosensitive drum 3 still, and then, the peripheral surface of the photosensitive drum 3 is developed with toner. In this case, the regions to which the toner adheres correspond to the discharge regions.

In this embodiment, a term "electric discharge region" is a region between the most upstream line at which electric discharge occurs between the charge roller 4 and the photosensitive drum 3, and the most downstream line at which electric discharge occurs between the charge roller 4 and the photosensitive drum 3, in terms of the rotational direction of the photosensitive drum 3. It also includes the region in which the charge roller 4 and the photosensitive drum 3 are in contact with each other, and therefore, no electric discharge occurs between them.

In the case of the image forming apparatus in this embodiment, the length L, in terms of the rotational direction of the charge roller 4, of the portion of the peripheral surface of the photosensitive drum 3 within the discharge region was 1.9 mm.

In order to permanently deform the charge roller 4, the photosensitive drum 3 and the charge roller 4 were placed in contact with each other, in exactly the same way as they would be placed in contact with each other during an actual image forming operation, and then, the image forming apparatus was left under a condition in which temperature was 40° C. and relative humidity was 95%. In the case of the charge roller 4 in this embodiment, the length n, in terms of the rotational direction of the charge. roller 4, of the permanently deformed portion of the peripheral surface of the charge roller 4 was 2.0 mm.

Thus, in this embodiment, the time it took for the permanently deformed portion of the charge roller 4 to pass the discharge region was 39 microseconds:

$$(L+n)/Vp=(1.9+2.0)/100=39\ (\text{msec}).$$

The response time tr of the constant current control was defined as the time it took to change the peak-to-peak voltage Vr, that is, the difference obtained by subtracting twice the electric discharge threshold voltage vth from the applied voltage Vpp (2000 V in this embodient, under normal temperature-normal humidity condition). The peak-to-peak voltage Vpp of the applied voltage is desired to be set to the smallest possible value which the peak-to-peak voltage Vpp takes while the constant current control is executed, that is, the value of the peak-to-peak voltage Vpp under high temperature-high humidity conditions (32.5° C. and 85% RH).

The threshold voltage Vth is the potential level of the applied DC voltage, at and above which the photosensitive drum 3 becomes charged when only DC voltage is applied. It changes depending on the permitivity and the thickness of the photosensitive layer.

In the case of the image forming apparatus in this embodiment, the actually measured discharge threshold voltage was 640 V, and therefore, the response time tr is the time necessary to change the peak-to-peak voltage Vpp of 720 V (Vr=2000−640×2 ×720). The actual value of the response time tr is desired to be obtained by measuring the time it takes for the AC voltage to rise from 0 V to 720 V after the AC voltage which has been turn off is turned on.

Table 1 given below shows the evaluation of images printed while varying the length of the response time tr. As is evident, from the table, even when a deformed charge roller was used, the photosensitive drum 3 was desirably charged as long as the constant current control was executed so that the response time tr became longer than the time (39 msec) it took for the deformed portion of the charge roller to pass through the discharge regions. In other words, according to this embodiment, the peak-to-peak voltage of the oscillating component of the bias applied to the charge roller remains constant regardless of whether the deformed portion of the charge roller, or the undamaged portion, passes the discharge regions. Therefore, the peripheral surface of the photosensitive drum is not charged in the aforementioned stripe pattern. The response time of the constant current control is desired to be shorter than the time it takes for the charge roller to rotate one full turn.

The length of the response time can be optionally set by changing the time constant, which is determined by the resistance and capacity of the integral network used to execute the constant current control.

TABLE 1

| Response | Image |
|---|---|
| 20 msec | improper charge |
| 30 msec | improper charge |
| 40 msec | good |
| 50 msec | good |

This embodiment was described with reference to an image forming apparatus in which the charge roller was rotated simply by the rotation of the photosensitive drum. However, this embodiment described above is also effective when the charge roller it driven independently from the photosensitive drum. Also, this embodiment is effective whether there is a difference in peripheral velocity between the charge roller and the photosensitive drum, or not. Further, this embodiment as described with reference to the charge roller which was structured in two layers, and a part of which was composed of foamed EPDM. However, the choice of charge roller does not need to be limited to the one referred to in the above description of this embodiment. In other words, the Structure of the charge roller does not need to be restricted as long as foamed material is used.

Embodiment 2

The resistance of a charging member fluctuates because the resistance of the material of the charging member fluctuates in response to changes in ambience. Therefore, the voltage necessary to desirably charge a photosensitive drum also changes in response to changes in ambience. Thus, it the AC component of the bias applied to the charge roller is subjected to the constant current control, the potential level (peak-to-peak voltage) of the AC component of the bias charged to the charge roller is automatically adjusted in response to the changes in ambience. On the other hand, the AC voltage range in which the photosensitive drum is desirably changed remains substantially constant regardless of ambience.

Figure 3:
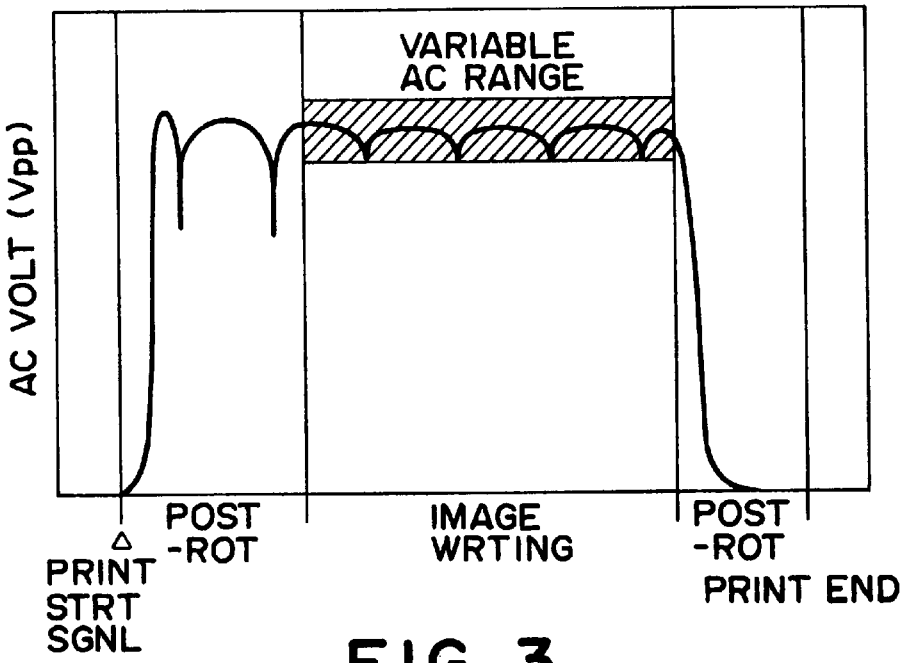
FIG. 3 is a graph which shows the AC voltage level change in the second embodiment of the present invention.

Thus, in this embodiment, the alternating component of the bias applied to the charging mere is kept under the constant current control illustrated in FIG. 3 That is, the alternating component of the bias charged to the charging member is always kept under the constant current control, and in addition, at least while the portion of the peripheral surface of the photosensitive member, which is going to become the image formation area, is charged, the fluctuation of the peak-to-peak voltage of the AC voltage is kept within the range, within which the photosensitive drum is desirably charged. When the charging apparatus was controlled in this manner, even if a deformed charge roller was used, a photosensitive roller was desirably charged. The aforementioned portion of the peripheral surface of the photosensitive member, which will become the image formation area, means the portion of the peripheral surface of the photosensitive drum, on which an image which reflects optional image formation data is formable, as the portion arrives at the exposing station.

Next, the portions of this embodiment, which are different from those in the first embodiment, will be concretely described with reference to a charging apparatus structured similarly to the one in the first embodiment.

When the portions of the peripheral surface of the photosensitive drum, on which no image was going to be formed as no image was formed on the peripheral surface of the photosensitive drum during the pre-rotation period, was in the charging station, that is, in contact with the charging roller, the AC voltage charged to the charge roller was kept under the constant current control so that the frequency remained at 1000 Hz, and the current value remained at 1000 $\mu$A. In the case of a charge roller with no deformed portion, the AC voltage applied to the charge roller was 2.1 kVpp in low temperature-low humidity ambience (15° C./10% RH), and 1.9 kVpp in high temperature-high humidity ambience (32.5° C./85% RH).

On the other hand, the voltage range in which a photosensitive drum was desirably charged for image formation was 1.75–2.45 kVpp in the low temperature-low humidity ambience, and 1.55–2.25 kVpp in the high temperature-high humidity ambience. Both differences between the potential level of the AC voltages (2.1 kVpp and 1.9 kVpp) measured during the pre-rotation period or the like, while keeping the AC component under the constant current control, and correspondent desirable voltage range (1.75–2.45 kVpp) and (1.55–2.25 kVpp) for image formation, fell within ±350 Vpp. Thus, the charging apparatus was provided with a limiter, so that the range for the potential level of the AC voltage applied to the charge roller while the portion of the photosensitive member, which would become the image formation region, was in the charging station, was limited based on the AC voltage values obtained using a normal charge roller during the pre-rotation period or the like. In other words, in the low temperature-low humidity ambience, the AC voltage was kept within a range of 1.75 kVpp–2.45 kVpp, based on the voltage of 2.1 kVpp applied during the pre-rotation period or the like, and in the high temperature-high humidity ambience, it was kept in a range of 1.55 kVpp–2.25 kVpp, based on the voltage of 1.9 kVpp applied during the pre-rotation period or the like.

In order to evaluate the effectiveness of this embodiment, imaged were printed by image forming apparatus, the charging apparatus of which employed a charge roller deformed similarly to the one used to test the first embodiment, keeping the AC component under the above described constant current control, that is, keeping the AC component under such a constant current control that while the portion of the peripheral surface of the photosensitive drum, which was going to become the image formation region, was in the charging station, the AC voltage value deviated no more than ±350 Vpp from the AC voltage value obtained using a normal charge roller. The evaluation or the thus formed image proved that thin embodiment was effective to desirably charge the photosensitive member regardless of ambience, It is desirable that the top and bottom values for the peak-to-peak voltage of the AC voltage applied to charge the portion of the peripheral surface of the photosensitive member, which will become the image formation region, are determined based on the average peak-to-peak voltage of the AC voltage measured through at least one full turn of the charge roller, during the prerotation period, under the constant current control.

Figure 4:
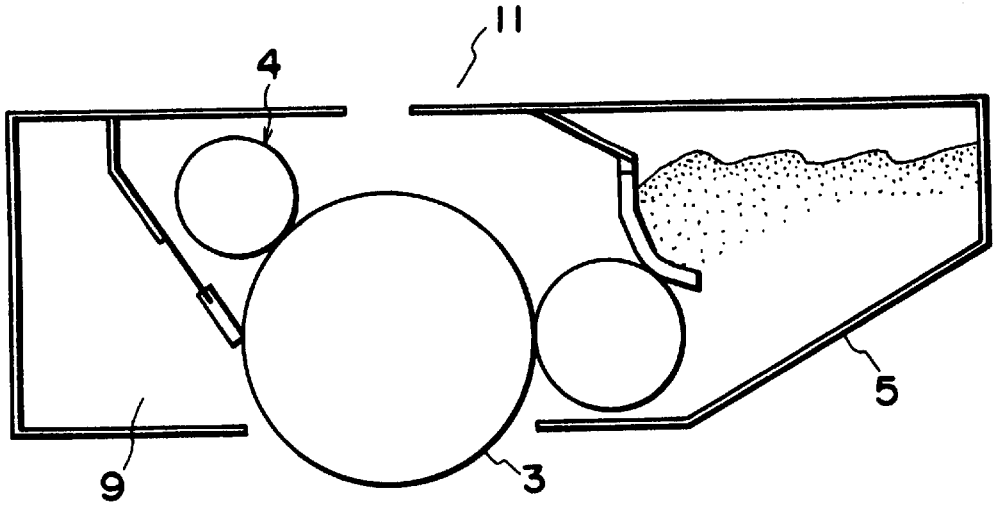
FIG. 4 is a schematic vertical section of the process cartridge in the third embodiment of the present invention.
Figure 5:
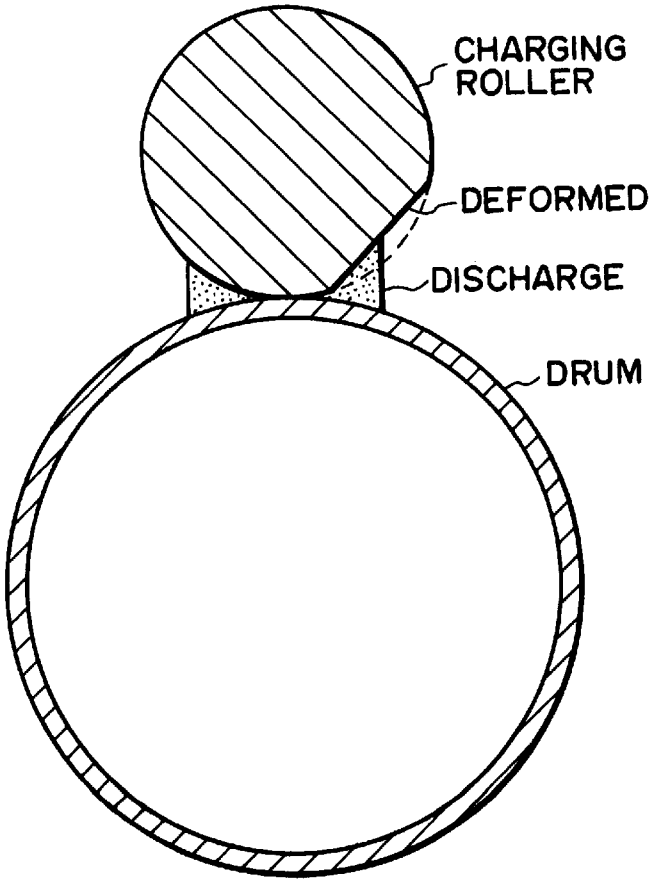
FIG. 5 is a schematic cross-sectional drawing which depicts a conventional charging means.

Next, referring to FIG. 4, a process cartridge usable with the image forming apparatus illustrated in FIG. 2 will be described.

As for the general structure of the process cartridge, the photosensitive drum 3, the charge roller 4, the developing apparatus 5, and the cleaning apparatus 9, are integrated in the for of a process cartridge 11, in which these structural and functional components are positioned to satisfy the predetermined positional relationship. The process cartridge 11 can be mounted in, or removed from, a predetermined space by being inserted, or pulled out, in a predetermined manner.

With an increase in the cumulative usage of an image forming apparatus, the various components such as the photosensitive drum, the charging apparatus, the developing apparatus, or the cleaning apparatus, wear out, reducing print quality. When such a problem occurs, all that the user needs to do to correct the problem is to replace the process cartridge. In other words, an image forming apparatus compatible with a processer cartridge is virtually maintenance free.

In all of the preceding embodiments, the oscillating voltage was composed of an alternating component as the oscillating component, and a direct current component as the constant component. However, an oscillating voltage may be composed by periodically turning on and off a direct current power source. In such a case, the waveform of the oscillating voltage becomes rectangular. It is not prerequisite for the oscillatiig voltage to be in a sine waveform; it may be in the triangular waveform, or in the pulse-wave ford which is formed by periodically turning on and off a direct current power source.

While the invention has been described with reference to the structures disclosed herein, it is not confined to the details set forth and this application is intended to cover such modifications or changes as may come within the purposes of the improvements or the scope of the following claims.

What is claimed is:

1. A charging apparatus comprising:

a rotatable charging roller contactable to a member to be charged to electrically charge the member to be charged, wherein said charging roller includes a foam member and is supplied with a voltage including an oscillating component;

control means for constant-current-control of the oscillating component;

wherein when the constant-current-control is carried out, a response time of the constant-current-control is longer than time required for a width of a nip between said charging roller and the member to be charged to pass through a discharge area between said charging roller and the member to be charged.

2. An apparatus according to claim 1, wherein the response time is shorter than time required for said charging roller to rotate one full turn.

3. An apparatus according to claim 1, wherein the nip width is the one measured after kept under contact conditions of use between said charging roller and the member to be charged for 30 days under 40° C. and 95% humidity.

4. An apparatus according to claim 1, wherein the member to be charged is an image bearing member for bearing an image.

5. A charging apparatus comprising:

a rotatable charging roller contactable to a member to be charged to electrically charge the member to be charged, wherein said charging roller is supplied with a voltage including an oscillating component;

control means for constant-current-control of the oscillating component;

wherein said control means effects the constant-current-control in a first period of time with a peak-to-peak voltage of the oscillating component, and the peak-to-peak voltage is limited within a range determined on the basis of a peak-to-peak voltage during a second period prior to the first period in which the constant-current-control is effected.

6. An apparatus according to claim 5, wherein said charging member is a foam member.

7. An apparatus according to claim 5, wherein said charging member is in the form of roller.

8. An apparatus according to claim 5, wherein the member to be charged is an image bearing member for bearing an image.

9. An apparatus according to claim 8, wherein the first period is a period in which an area of said image bearing member which is going to be an image area is in a charging position of said charging member.

10. An apparatus according to claim 9, wherein the second period is a period it which an area of said image bearing member which is going to be a non-image area is in a charging position of said charging member.

11. An apparatus according to claim 6, wherein said charging member is in the form of roller.

* * * * *

UNITED STATES PATENT AND TRADEMARK OFFICE

CERTIFICATE OF CORRECTION

PATENT NO. : 6,014,529

DATED : January 11, 2000

INVENTOR(S) : HIROSHI SATO

It is certified that error appears in the above-identified patent and that said Letters Patent is hereby corrected as shown below:

[57] Abstract:
line 3, change "eharging" to --charging--.

Column 9:
line 40, "component" should read --component; and--;
line 42, "component;" should read --component,--.

Column 10,
line 7, "after" should read --after being--;
line 18, 'component;" should read --component; and--;
line 20, "component;" should read --component,--; and
line 40, "it" should read --in--.

Signed and Sealed this

Twenty-seventh Day of March, 2001

*Attest:*

Nicholas P. Godici

NICHOLAS P. GODICI

*Attesting Officer*

*Acting Director of the United States Patent and Trademark Office*